US009142333B2

(12) United States Patent
Kaga et al.

(10) Patent No.: US 9,142,333 B2
(45) Date of Patent: Sep. 22, 2015

(54) DIFFERENTIAL SIGNAL TRANSMISSION CABLE AND METHOD OF MAKING SAME

(71) Applicant: Hitachi Metals, Ltd., Tokyo (JP)

(72) Inventors: Masafumi Kaga, Hitachi (JP); Sohei Kodama, Hitachi (JP); Akinari Nakayama, Hitachinaka (JP)

(73) Assignee: Hitachi Metals, Ltd., Tokyo (JP)

( * ) Notice: Subject to any disclaimer, the term of this patent is extended or adjusted under 35 U.S.C. 154(b) by 169 days.

(21) Appl. No.: 14/045,363

(22) Filed: Oct. 3, 2013

(65) Prior Publication Data

US 2014/0090869 A1 Apr. 3, 2014

(30) Foreign Application Priority Data

Oct. 3, 2012 (JP) ..... 2012-221563
Oct. 3, 2013 (JP) ..... 2013-207790

(51) Int. Cl.

*H01B 7/00* (2006.01)
*H01B 13/14* (2006.01)
*H01B 11/18* (2006.01)
*H01B 11/00* (2006.01)

(52) U.S. Cl.

CPC ..... *H01B 7/00* (2013.01); *H01B 11/1839* (2013.01); *H01B 13/142* (2013.01); *H01B 11/002* (2013.01)

(58) Field of Classification Search

USPC ..... 174/110 R, 110 PM, 113 R, 113 AS, 115, 174/116, 112, 110 F

See application file for complete search history.

(56) References Cited

U.S. PATENT DOCUMENTS

| | | | | |
|---|---|---|---|---|
| 5,283,390 | A * | 2/1994 | Hubis et al. | 174/36 |
| 6,403,887 | B1 * | 6/2002 | Kebabjian et al. | 174/110 R |
| 7,999,185 | B2 * | 8/2011 | Cases et al. | 174/113 R |
| 8,378,217 | B2 * | 2/2013 | Sugiyama et al. | 174/113 R |
| 8,440,910 | B2 * | 5/2013 | Nonen et al. | 174/115 |
| 8,546,691 | B2 * | 10/2013 | Watanabe et al. | 174/105 R |
| 2010/0300725 | A1 * | 12/2010 | Nakayama et al. | 174/110 SR |
| 2011/0083877 | A1 * | 4/2011 | Sugiyama et al. | 174/115 |
| 2011/0198106 | A1 * | 8/2011 | Sasamura et al. | 174/110 SR |
| 2012/0024566 | A1 * | 2/2012 | Shimosawa et al. | 174/107 |

FOREIGN PATENT DOCUMENTS

JP 2001-035270 A 2/2001

* cited by examiner

*Primary Examiner* — William H Mayo, III
(74) *Attorney, Agent, or Firm* — McGinn IP Law Group, PLLC

(57) ABSTRACT

A differential signal transmission cable includes two core wires, and a foamed insulation that collectively covers the two core wires by foaming extrusion molding. The foamed insulation is not more than 5% in a dispersion of foaming degree defined below in a cut surface when the cable is cut orthogonally to a longitudinal direction of the cable. In the cut surface, five regions are determined according to a predetermined procedures and a foaming degree (%) of the respective regions is measured. The dispersion of the foaming degree is defined by a difference between a foaming degree (%) in the region with a maximum foaming degree and a foaming degree (%) in the region with a minimum foaming degree.

5 Claims, 6 Drawing Sheets

DIFFERENTIAL SIGNAL TRANSMISSION CABLE AND METHOD OF MAKING SAME

The present application is based on Japanese patent application Nos. 2012-221563 and 2013-207790 filed on Oct. 3, 2012 and Oct. 3, 2013, respectively, the entire contents of which are incorporated herein by reference.

BACKGROUND OF THE INVENTION

1. Field of the Invention

The invention relates to a differential signal transmission cable and a method of making the differential signal transmission cable.

2. Description of the Related Art

A method of making parallel-type coaxial cable with a low skew is known that a foamed insulating material is collectively extrusion-molded on a pair of inner conductors extending in parallel to have a circular or elliptical shape in sectional view, an outer conductor is then formed on the periphery of the foamed insulating material, and the outer conductor and the foamed insulating material are tightly covered with an insulating jacket (see JP-A-2001-035270).

By means of the method disclosed in JP-A-2001-035270, it is possible to provide a cable with a reduced dispersion of foaming degree in the longitudinal direction of the cable. Thus, such a low skew can be obtained that cannot be reached by a conventional cable (or a twinax cable) that two foamed insulated wires with single cores are arranged in parallel so as to be a pair.

SUMMARY OF THE INVENTION

However, when using the collective extrusion molding method, the position of core wires or foaming degree in the cross section of the cable may be dispersed. Therefore, it is impossible to pursue a further low skew (especially 10 ps/m or less) by the method.

It is an object of the invention to provide a differential signal transmission cable and a method of making the cable that can realize a further low skew by reducing the dispersion of the position of the cores or the foaming degree in the cross section of the cable.

(1) According to one embodiment of the invention, a differential signal transmission cable comprises:

two core wires; and a foamed insulation that collectively covers the two core wires by foaming extrusion molding, wherein the foamed insulation is not more than 5% in a dispersion of foaming degree defined below in a cut surface when the cable is cut orthogonally to a longitudinal direction of the cable.

The dispersion of foaming degree is defined as follows:

In the cut surface, five regions are determined according to the next procedures (a) to (c) and a foaming degree (%) of the respective regions is measured. The dispersion of the foaming degree is defined by a difference between a foaming degree (%) in the region with a maximum foaming degree and a foaming degree (%) in the region with a minimum foaming degree.

(a) A line $X_a$ contacting with upper ends of the two core wires and a line $X_b$ contacting with lower ends of the two core wires are drawn so as to reach both horizontal ends of the foamed insulation.

(b) A line $Y_a$ and a line $Y_b$ contacting with opposite ends of the two core wires and orthogonal to the line $X_a$ and $X_b$ are drawn so as to reach both vertical ends of the foamed insulation.

(c) The five regions are each defined as a region A surrounded by a line $X_a$, a line $X_b$, a line $Y_a$ and an outer periphery of the foamed insulation between the line $X_a$ and the line $X_b$, a region B surrounded by the line $X_a$, the line $X_b$, a line $Y_b$ and an outer periphery of the foamed insulation between the line $X_a$ and the line $X_b$, a region C surrounded by the line $X_a$, the line $X_b$, the line $Y_a$ and the line $Y_b$, a region D surrounded by the line $X_a$, the line $Y_a$, the line $Y_b$ and an outer periphery of the foamed insulation between the line $Y_a$ and the line $Y_b$, and a region E surrounded by the line $X_b$, the line $Y_a$, the line $Y_b$ and an outer periphery of the foamed insulation between the line $Y_a$ and the line $Y_b$.

In the above embodiment (1) of the invention, the following modifications and changes can be made.

(i) The cable is not more than 0.10 in a symmetry degree $\alpha$ defined below.

The symmetry degree $\alpha$ is defined as follows:

In the cut surface, a line X is drawn so as to pass through centers of the two core wires. A midpoint of a line to connect the centers of the two core wires on the line X is defined as an origin $L_o(0,0)$. Intersections between the line X and an outer periphery of the foamed insulation are defined as $X_1$ and $X_2$. The midpoint of the line $X_1$-$X_2$ to connect $X_1$ and $X_2$ is defined as $L_x$. In drawing a line Y that passes through the $L_x$ and is orthogonal to the line $X_1$-$X_2$, intersections between the line Y and an outer periphery of the foamed insulation are defined as $Y_1$ and $Y_2$. The midpoint of the line $Y_1$-$Y_2$ to connect $Y_1$ and $Y_2$ is defined as $L_y$. A linear distance between the origin $L_o(0,0)$ and $L_y$ is defined as L. A value obtained by dividing the distance L by a diameter a of the core wire is defined as a symmetry degree $\alpha$.

(ii) A skew of not more than 5 ps/m is obtained in the cable.

(2) According to another embodiment of the invention, a method of making the differential signal transmission cable as defined in the above embodiment (1), the method comprises controlling such that an uneven flow index of an extruded resin is not more than 1.5, where the uneven flow index is defined as a value obtained by dividing a resin maximum flow rate in a die by a resin mean flow rate in the die at the time of foaming extrusion molding that the two core wires are collectively covered with the foamed insulation.

Effects of the invention

According to one embodiment of the invention, a differential signal transmission cable can be provided that can realize a further low skew by reducing the dispersion of the position of the cores or the foaming degree in the cross section of the cable, as well as a method of making the cable.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS (Configuration of Differential Signal Transmission Cable)

Figure 1:
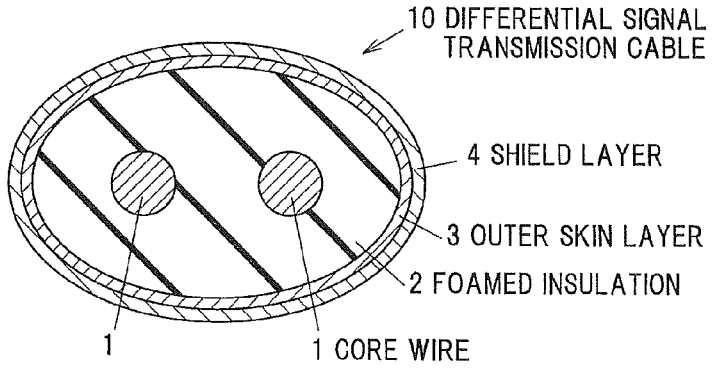
FIG. 1 is a schematic cross sectional view showing a differential signal transmission cable in an embodiment of the present invention.
Figure 2:
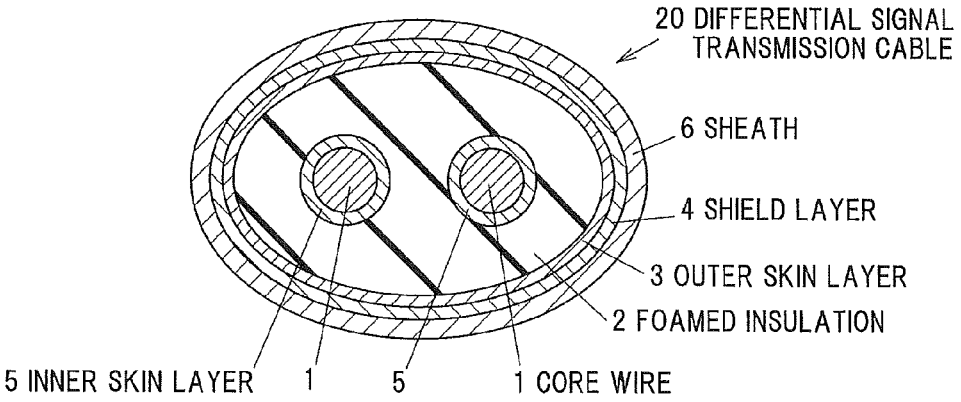
FIG. 2 is a schematic cross sectional view showing a differential signal transmission cable in a modification of the cable in FIG. 1.

FIG. 1 is a schematic cross sectional view showing a differential signal transmission cable in the embodiment of the present invention. FIG. 2 is a schematic cross sectional view showing a differential signal transmission cable in the modification of the cable in FIG. 1.

The differential signal transmission cable 10 of the embodiment of the invention is configured such that two core wires 1 are collectively covered with a foamed insulation 2 by a foaming extrusion molding method. As shown in FIG. 1, if necessary, an outer skin layer 3 may be formed inside the foamed insulation 2, and a shield layer 4 may be formed outside the outer skin layer 3.

Furthermore, as shown in FIG. 2, a differential signal transmission cable 20 in the modification of the cable in FIG. 1 is modified such that, if necessary, an inner skin layer 5 may be formed inside the foamed insulation 2 and a sheath 6 may be also formed outside the shield layer 4.

The two core wires 1 are preferably arranged in parallel. The core wire may be formed of a single solid wire or twisted wires and it may be formed of, e.g., a copper wire or various alloy wires. Optionally, it may be formed of a tubular conductor. Furthermore, a plating of an arbitrary material such as copper, tin, nickel and gold may be formed on the surface.

The foamed insulation 2 may be formed of a single foamed layer or a combination of multiple foamed layers. The resin material of the foamed insulation 2 may be, e.g. polyolefin. If the resin has a unit obtained by polymerizing olefin, it can be used without particular limitation, and it includes low-density polyethylene, high-density polyethylene, linear low-density polyethylene, ultralow density polyethylene, ethylene-hexene copolymer, ethylene-octene copolymer, ethylene-vinyl acetate copolymer, ethylene-ethyl acrylate copolymer, ethylene-methyl acrylate copolymer, ethylene-methyl methacrylate copolymer, polypropylene, ethylene copolymer polypropylene, reactor blend type polypropylene, cycloolefin polymer, poly-4-methyl-1-pentene. Those can be used either alone or in a blend of not less than two.

As a foaming method of a resin material, there are two methods of a chemical foaming method and a physical foaming method. The former is configured to form air bubbles by kneading a chemical foaming agent in the resin material, and generating a gas by thermal decomposition of the chemical foaming agent in the resin material. The latter is configured to form air bubbles by injecting a gas into an extruder to dissolve it in the resin material, and vaporizing the gas dissolved in the resin material by pressure drop at the die outlet of the extruder head.

As the chemical foaming agent, it is selected so as to fit the molding temperature of the resin. For example, the chemical foaming agent may be (A) an organic chemical foaming agent such as azodicarbonamide, azobisisobutyronitrile, barium azodicarboxylate, dinitrosopentamethylenetetramine, 4,4'-oxybis(benzenesulfonylhydrazide), N,N'-dinitrosopentamethylenetetramine, benzenesulfonylhydrazide, bistetrazole diammonium, bistetrazole piperazine, 5-phenyltetrazole, (B) an inorganic chemical foaming agent such as carbonate, bicarbonate, nitrite, hydride, and (C) an auxiliary foaming agent such as metal oxide (such as zinc oxide, magnesium oxide), fatty acid salt, inorganic zinc compound, urea-based compound, organic acid, amine compound. Those can be used either alone or in a blend of not less than two. The azodicarbonamide can be preferably used since it fits the molding temperature of polyolefin.

The physical foaming method can use nitrogen gas, carbon dioxide gas, air, pentane, butane and chlorofluorocarbon compound. Nitrogen gas or carbon dioxide gas can be suitably used in terms of the solubility to the resin, the safety and the global environmental protection. Nitrogen gas is most suitably used since it can be reduced in bubble diameter.

The outer skin layer 3 and the inner skin layer 5 are a covering layer that is not foamed or has a lower foaming degree than the foamed insulation 2. The material for the outer skin layer 3 and the inner skin layer 5 may be, e.g. tetrafluoroethylene perfluoroalkylvinylether copolymer (PFA), tetrafluoroethylene hexafluoropropylene copolymer (FEP), ethylene tetrafluoroethylene copolymer (ETFE).

The shield layer 4 may be, according to the use and need, arbitrarily selected from a served or braided winding of a fine metal wire, a winding (served or longitudinal winding) of a metal foil, and a corrugated structure of a longitudinal wound metal. For example, it may be a braid of copper wire, a braid of tin plated copper wire, a braid of silver plated copper wire, a copper foil tape, a copper tape/polyester film, an aluminum foil/nylon laminated tape, a copper corrugated tube, an aluminum straight tube and an aluminum corrugated tube.

The sheath 6 may be, e.g. a polyolefin such as polyethylene, polypropylene, polyvinylchloride and ethylene-vinyl acetate copolymer, a fluorine resin, a halogen-free flame-retardant polyolefin, and a flexible vinylchloride resin.

The form of the foamed insulated wire composing the differential signal transmission cable 10 may be optional. As shown in FIGS. 1 and 2, it may be preferably elliptical such that a cross section when it is cut orthogonally to the longitudinal direction of the cable is elongate in the arrangement direction of the two core wires 1. Alternatively, it may have a shape of an oblate ellipsoid that the cross section is formed with parallel flat sections in the arrangement direction of the two core wires 1.

The differential signal transmission cable 10 may be formed with a drain line but it is preferably formed with no drain line.

Figure 3:
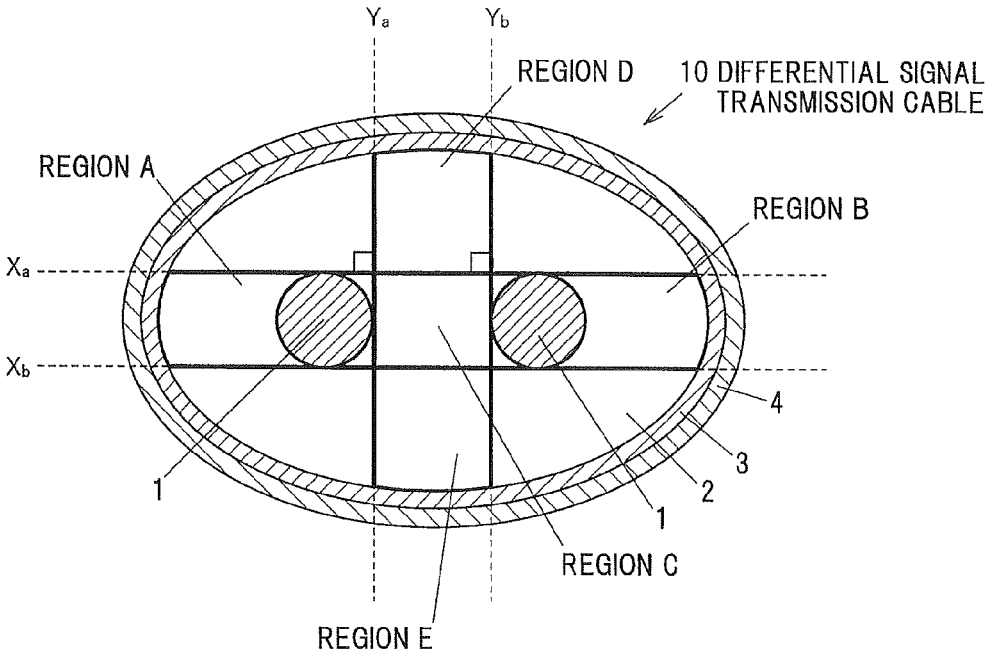
FIG. 3 is a schematic cross sectional view illustrating the definition to a dispersion of foaming degree.

FIG. 3 is a schematic cross sectional view illustrating the definition to a dispersion of foaming degree.

The differential signal transmission cable 10 (or the foamed insulation 2) is not more than 5% in a dispersion of foaming degree defined below in a cut surface that the cable is cut orthogonally to the longitudinal direction of the cable. It has preferably a dispersion of not more than 4.5%, more preferably a dispersion of not more than 4%, and most preferably a dispersion of not more than 3.5%.

<Definition: Dispersion of Foaming Degree>

In the cut surface, five regions are determined according to the next procedures (a) to (c) and a foaming degree (%) of the respective regions is measured. A dispersion of the foaming degree is defined by a difference between a value (foaming degree %) in the region with a maximum foaming degree and a value (foaming degree %) in the region with a minimum foaming degree.

(a) A line $X_a$ contacting with the upper ends of the two core wires 1 and a line $X_b$ contacting with the lower ends of the two core wires 1 are drawn so as to reach both horizontal ends of the foamed insulation 2.

(b) A line $Y_a$ and a line $Y_b$ contacting with the opposite ends of the two core wires 1 and orthogonal to the line $X_a$ and $X_b$ are drawn so as to reach both vertical ends of the foamed insulation 2.

(c) The five regions are each defined as a region A surrounded by the line $X_a$, the line $X_b$, the line $Y_a$ and an outer periphery of the foamed insulation 2 between the line $X_a$ and the line $X_b$, a region B surrounded by the line $X_a$, the line $X_b$, the line $Y_b$ and an outer periphery of the foamed insulation 2 between the line $X_a$ and the line $X_b$, a region C surrounded by the line $X_a$, the line $X_b$, the line $Y_a$ and the line $Y_b$, a region D surrounded by the line $X_a$, the line $Y_a$, the line $Y_b$ and an outer periphery of the foamed insulation 2 between the line $Y_a$ and the line $Y_b$, and a region E surrounded by the line $X_b$, the line $Y_a$, the line $Y_b$ and an outer periphery of the foamed insulation 2 between the line $Y_a$ and the line $Y_b$.

By controlling the dispersion of the foaming degree in the five regions A to E as defined above so as to be not more than 5%, a differential signal transmission cable can be provided that that can realize a further low skew by reducing the dispersion of the position of the cores or the foaming degree in the cross section of the cable.

Furthermore, it is preferred that the differential signal transmission cable 10 (i.e., the position of the two core wires in the cable) is not more than 0.10 in a symmetry degree α defined below. FIG. 4 and FIGS. 5A to 5C are schematic cross sectional views illustrating the definition of the symmetry degree.

<Definition: Symmetry Degree α>

In the cut surface, a line X is drawn so as to pass through the centers of the two core wires 1. The midpoint of the line to connect the centers of the two core wires 1 on the line X is defined as an origin $L_o(0,0)$. The intersections between the line X and the outer periphery of the foamed insulation 2 are defined as $X_1$ and $X_2$. The midpoint of the line $X_1$-$X_2$ to connect $X_1$ and $X_2$ is defined as $L_x$. Where a line Y is drawn that passes through the $L_x$ and is orthogonal to the line $X_1$-$X_2$, the intersections between the line Y and the outer periphery of the foamed insulation 2 are defined as $Y_1$ and $Y_2$. The midpoint of the line $Y_1$-$Y_2$ to connect $Y_1$ and $Y_2$ is defined as $L_y$. The linear distance between the origin $L_o(0,0)$ and $L_y$ is defined as L. A value obtained by dividing the distance L by a diameter a of the core wire 1 is defined as a symmetry degree α.

By controlling the symmetry degree α as defined above so as to be not more than 0.10, a differential signal transmission cable can be provided that that can realize a further low skew by reducing the dispersion of the position of the cores or the foaming degree in the cross section of the cable.

Figure 4:
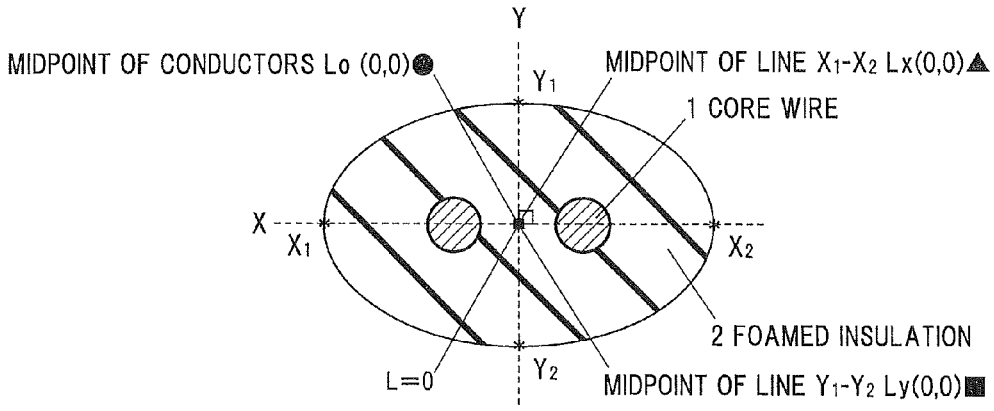
FIG. 4 is a schematic cross sectional view illustrating the definition of a symmetry degree.

FIG. 4 is a cross sectional view showing an example of a preferred embodiment that there is no deviation in the position of the two core wires 1. In the embodiment of FIG. 4, the positions of the origin $L_o(0,0)$, the point $L_x$ and the point $L_y$ are coincident with each other and the distance L=0 is obtained. Thus, the symmetry degree α is calculated 0/a=0.

Figure 5A:
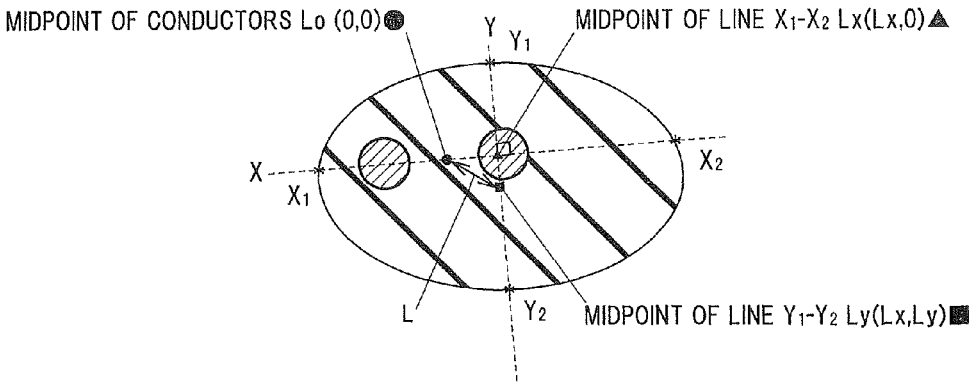
FIGS. 5A to 5C are schematic cross sectional views illustrating the definition of the symmetry degree.
Figure 5B:
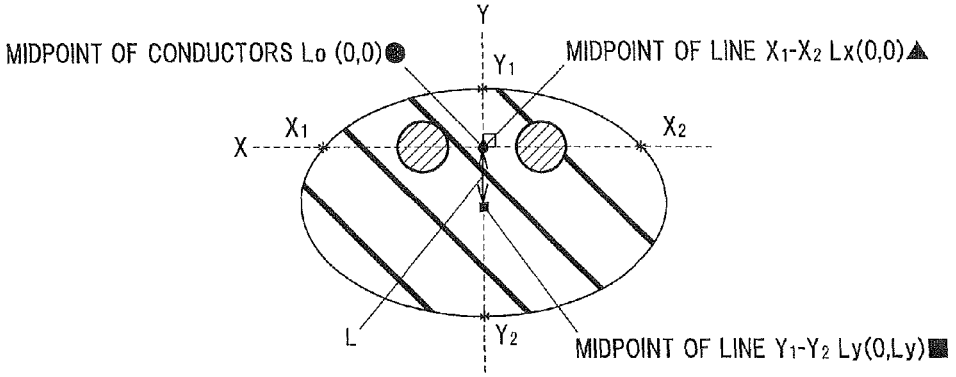
Figure 5C:
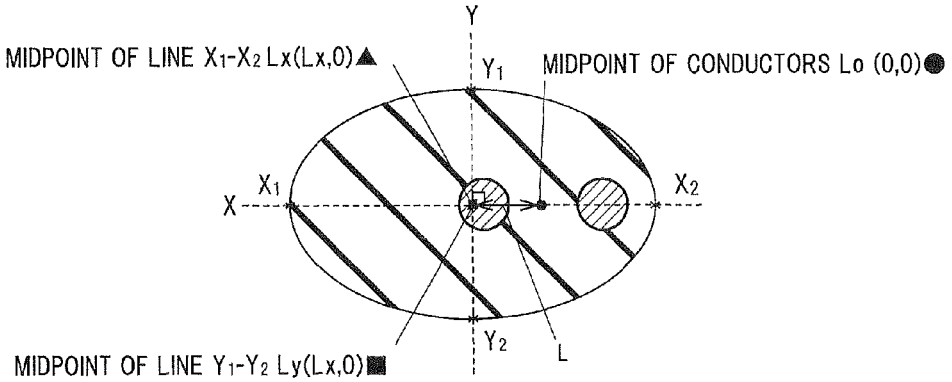

FIGS. 5A to 5C are schematic cross sectional views illustrating the case that there is a deviation in the position of the two core wires 1. FIG. 5A is the case that they are biased upward and leftward. FIG. 5B is the case that they are biased upward. FIG. 5C is the case that they are biased rightward.

In FIG. 5A where the coordinate of the point $L_y$ is $(L_x, L_y)$, the symmetry degree α is obtained by the following formula.

$$\alpha=L/a=\sqrt{Lx^2+Ly^2}/a$$

In FIG. 5B where the coordinate of the point $L_y$ is $(0, L_y)$, the symmetry degree α is obtained by the following formula.

$$\alpha=L/a=\sqrt{Ly^2}/a$$

In FIG. 5C where the coordinate of the point $L_y$ is $(L_x, 0)$, the symmetry degree α is obtained by the following formula.

$$\alpha=L/a=\sqrt{Lx^2}/a$$

(Use of Differential Signal Transmission Cable)

The differential signal transmission cable 10 of the embodiment is suited to a large-capacity and high-speed transmission of several Gbps or more and can be suitably used for a high-speed transmission in a 10 Gbps or more class.

(Method of Making Differential Signal Transmission Cable)

The method of making the differential signal transmission cable 10 of the embodiment is characterized in that an uneven flow index thereof is not more than 1.5, where the uneven flow index is defined as a value obtained by dividing a resin maximum flow rate in the die by the resin mean flow rate in the die at the time of the foaming extrusion molding that the two core wires 1 are collectively covered with the foamed insulation 2. The uneven flow index is preferably not more than 1.4, more preferably not more than 1.35, most preferably not more than 1.3.

If the uneven flow index is more than 1.5, no stress balance in the die will be secured. Therefore, the dispersion of the foaming degree increases, so that a position deviation (or biasing) of the core wires may occur. Thus, the symmetry degree α may be more than 0.10 so as to increase the skew.

The flow rate distribution (m/s) can be obtained by calculating the steady solution of the following equation of continuity and Navier-Stokes equation.

$$\partial\rho/\partial t+\nabla\cdot(\rho v)=0$$

$$\rho[\partial v/\partial t+(v\cdot\nabla)v]=\nabla p-\nabla\tau$$

In the equation, ∂/∂t is obtained by a partial differentiation to time, ∇ is obtained by a partial differentiation to space, e.g. in the orthogonal coordinate system by (∂/∂x, ∂/∂y, ∂/∂z). $\rho(kg/m^3)$ is a density of resin, p (Pa) is pressure, τ (Pa) is stress which is evaluated by Newtonian fluid and may be optionally evaluated by non-Newtonian fluid.

Effects of the Embodiment

According to the embodiment of the invention, a differential signal transmission cable can be provided that can realize a further low skew by reducing the dispersion of the position of the cores or the foaming degree in the cross section of the cable, as well as a method of making the cable. In a preferred embodiment of the invention, the skew between the two core wires 1 can be reduced to not more than 10 ps/m, more preferably not more than 5 ps/m and most preferably not more than 3 ps/m.

Examples

The foamed insulated wire is manufactured by using a 45 mm extruder with a die having an elliptical opening. A core bar is attached inside the die so as to pass two core wires. A 24 AWG silver-plated copper conductor (with a diameter of 0.55 mm) is used as the core wire. Polyethylene resin is used as the material of the foamed insulation. Azodicarboxylic amide (ADCA) is used the chemical foaming agent. The additive amount is 1% relative to the polyethylene resin. The two cores are collectively extruded while controlling the rotation and linear speed of the screw.

The uneven flow index of the embodiment is reduced to not more than 1.5 by properly using a die with an aspect ratio (long diameter/short diameter) of 1.5 to 3.0 so as to control the distance between the two core wires. Also, in the embodiment, in order to equalize the flow rate between the core wires and the flow rate at the horizontal and vertical regions (or regions A to E) in the cross section, the flow rate distribution is regulated by expanding a flow path with a low flow rate.

The foaming degree is measured by image processing for the regions A to E. Then, the dispersion of the foaming degree is calculated. At first, the cable manufactured above is cut and the cut surface is shot by an electronic microscope. Then, the foaming degree of the foamed insulation is obtained by measuring the specific gravity of the foamed insulation. The measurement method conforms to JIS (Japanese Industrial Standards) Z 8807:2012, "Methods of measuring density and specific gravity of solid". Then, the image thus shot is binarized into white and black. The cut surface of the foamed insulation is categorized into a bubble part and a bubble wall part. The ratio of white and black is adjusted by the measured foaming degree. The bubble wall part is a resin part (non-bubble part) of the foamed insulation. Then, the area (or number of pixels) of the white part and the black part are measured and the foaming degree in the cut surface of the cable is calculated by the next equation.

$$\text{Foaming degree}=B/(A+B)\times 100(\%)$$

where A is the number of pixels of bubble walls (black) and B is the number of pixels of bubbles (white).

The foaming degree of the respective regions is calculated and the dispersion of the foaming degree in the cut surface is evaluated. The results are shown in Tables 1 and 2.

If the inner skin layer and the outer skin layer are equipped, the specific gravity of the foamed insulation including the inner skin layer and the outer skin layer is measured so as to determine the foaming degree. The Thus, the white-black binarization of the image shot is conducted by adjusting the white-black ratio while including the inner skin layer and the outer skin layer. Then, by using the above equation, the foaming degree in the cut surface of the cable is calculated at the respective regions (i.e. not including the inner skin layer and the outer skin layer) of the foamed insulation. Here, the foamed insulation is defined as a region that completely encloses all bubbles and is enclosed by a closed curve being outwardly convex so as to minimize the enclosed area. Thereby, in the cut surface of the cable, the inner skin layer and the outer skin layer can be differentiated from the foamed insulation.

The symmetry degree α (L/a) is obtained as follows. The results are shown in Tables 1 and 2. For example, as mentioned previously in the definition of the symmetry degree α, the linear distance L from the origin $L_o(0,0)$ to the point $L_y$ is measured by drawing a line on the photograph of the cut surface according to the definition. Then, the symmetry degree α is calculated by dividing the L by the diameter a=0.55 mm of the core wire.

The resin maximum flow rate (Vmax) and resin mean flow rate (Va) are obtained as follows. Then, the uneven flow index (Vmax/Va) is calculated. The results are shown in Tables 1 and 2.

The shield layer is made by winding the laminated tape with a copper tape and a polyester film on the foamed insulated wires thus obtained. Then, a sheath of flexible polyvinyl chloride is attached on the shield layer. Thus, two-core parallel coaxial cables with a length of 30 m are completed.

The 30 m cables thus manufactured are each divided at intervals of 5 m into six cables. The delay time difference (or skew) of them is measured by a TDR (time domain reflectometer). The results are shown in Tables 1 and 2. The sample with a skew not more than 10 ps/m is evaluated "passed".

The appearance of the foamed insulated wire after the extrusion molding is evaluated by the following criteria. The results are shown in Tables 1 and 2.

Passed: smooth

Failed: not smooth (i.e. uneven or textured)

The comprehensive evaluation is obtained by the following criteria. The results are shown in Tables 1 and 2.

○: passed both in skew and appearance x: failed in skew or appearance or both in skew and appearance

TABLE 1

| | | Example 1 | Example 2 | Example 3 | Example 4 | Example 5 |
|---|---|---|---|---|---|---|
| Foaming degree (%) | region A | 51.3 | 50.1 | 47.2 | 40.2 | 48.3 |
| | region B | 50.9 | 50.2 | 48.6 | 40.5 | 51.3 |
| | region C | 49.3 | 46.4 | 45.5 | 40.1 | 47.1 |
| | region D | 50.5 | 48.1 | 49.0 | 40.1 | 48.6 |
| | region E | 50.8 | 48.9 | 48.8 | 40.7 | 48.7 |
| Dispersion of foaming degree (%) | | 2.0 | 3.8 | 3.5 | 0.6 | 4.2 |
| L (mm) | | 0.02 | 0.04 | 0.03 | 0.01 | 0.05 |
| Symmetry degree α L/a | | 0.04 | 0.07 | 0.05 | 0.02 | 0.09 |
| Resin maximum flow rate Vmax (m/s) | | 1.05 | 1.09 | 1.06 | 0.89 | 1.34 |
| Resin mean flow rate Va (m/s) | | 0.88 | 0.83 | 0.87 | 0.81 | 0.90 |
| Uneven flow index Vmax/Va | | 1.19 | 1.31 | 1.22 | 1.10 | 1.49 |
| Skew (ps/m) | | 2.1 | 2.9 | 2.4 | 0.6 | 4.9 |
| Appearance | | Passed | Passed | Passed | Passed | Passed |
| Comprehensive evaluation | | ○ | ○ | ○ | ○ | ○ |

TABLE 2

| | | Comparative Example 1 | Comparative Example 2 | Comparative Example 3 | Comparative Example 4 |
|---|---|---|---|---|---|
| Foaming degree (%) | region A | 51.0 | 55.0 | 58.3 | 50.2 |
| | region B | 47.0 | 49.7 | 43.4 | 41.9 |
| | region C | 55.0 | 55.4 | 57.7 | 49.9 |
| | region D | 52.3 | 54.4 | 58.1 | 50.5 |
| | region E | 53.8 | 54.1 | 58.2 | 49.2 |
| Dispersion of foaming degree (%) | | 8.0 | 5.7 | 14.9 | 8.6 |
| L (mm) | | 0.08 | 0.07 | 0.40 | 0.06 |
| Symmetry degree α L/a | | 0.15 | 0.13 | 0.73 | 0.11 |
| Resin maximum flow rate Vmax (m/s) | | 2.17 | 1.22 | 2.10 | 1.62 |
| Resin mean flow rate Va (m/s) | | 0.99 | 0.78 | 0.91 | 0.86 |
| Uneven flow index Vmax/Va | | 2.19 | 1.56 | 2.31 | 1.88 |
| Skew (ps/m) | | 15.2 | 10.9 | 18.1 | 12.4 |
| Appearance | | Passed | Passed | Failed | Failed |
| Comprehensive evaluation | | X | X | X | X |

Figure 6:
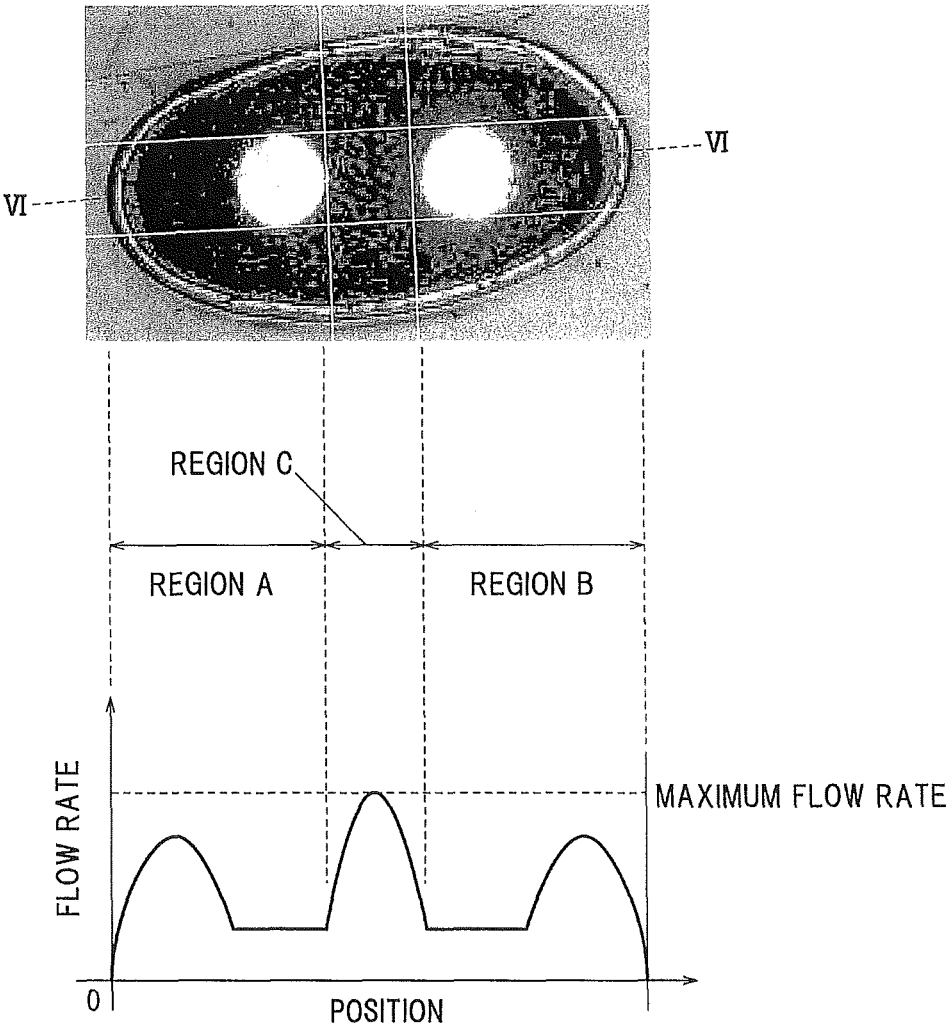
FIG. 6 is a photograph (above) showing a cross section of the differential signal transmission cable and a result (below) of flow rate analysis in Example 1.
Figure 7:
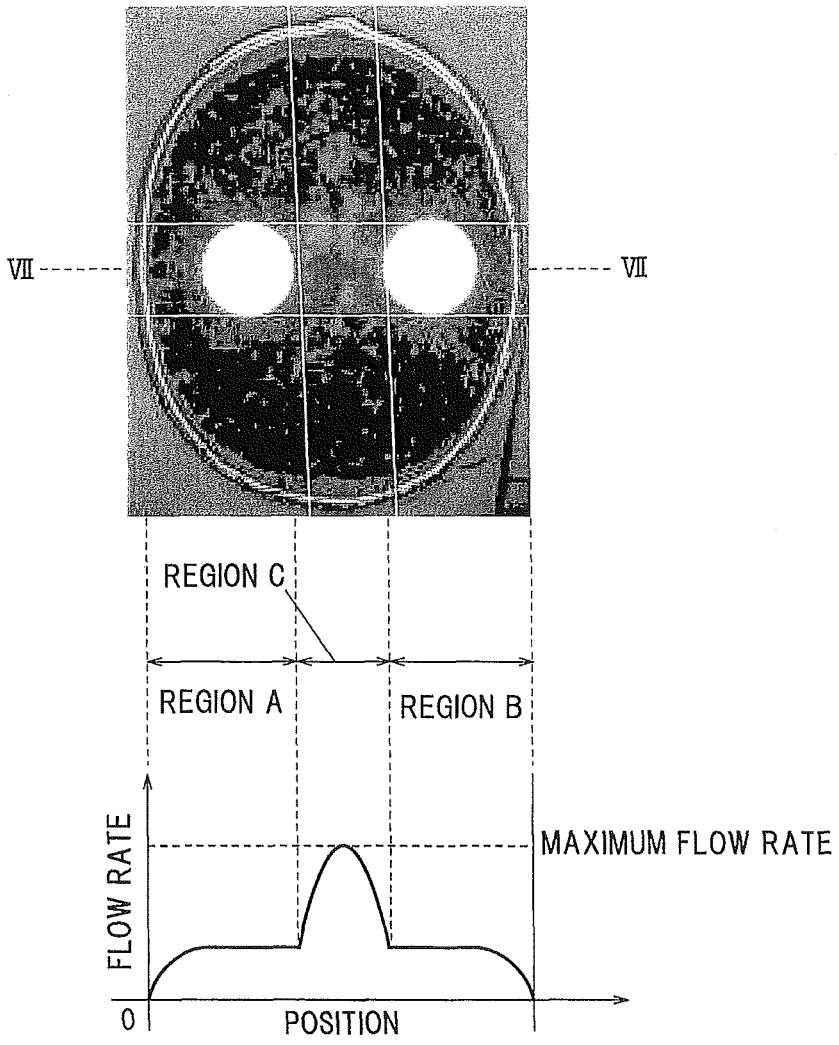
FIG. 7 is a photograph (above) showing a cross section of the differential signal transmission cable and a result (below) of flow rate analysis in Comparative Example 1.

FIG. 6 is a photograph (above) showing a cross section of the differential signal transmission cable and a result (below) of flow rate analysis (flow rate analysis (including the resin flow rate and drawing speed) along a line VI-VI in the photograph of the cross section) in Example 1. FIG. 7 is a photograph (above) showing a cross section of the differential signal transmission cable and a result (below) of flow rate analysis (flow rate analysis (including the resin flow rate and drawing speed) along a line VII-VII in the photograph of the cross section) in Comparative Example 1.

In the flow rate distribution of Examples 1 to 5, the peaks of resin flow rate are found at the center and both sides (i.e. in the regions A to C). For example, in the region C, the peak with the maximum flow rate is found. Also in the regions A and B, the peaks of resin flow rate are found that is lower than the maximum flow rate but clear. Due to the stabilized flow rate, the dispersion of the foaming degree in the regions A to E can be reduced to not more than 5% and the symmetry degree $\alpha$ can be reduced to not more than 0.10. Thus, it is important to have the peaks of the resin flow rate in the regions A to C respectively. It is preferred that the peak height of the regions A and B is close to that of the region C. It is more preferred that it is not lower than a half of the peak height of the region C. It is most preferred that it is not lower than two thirds of the peak height of the region C.

In the flow rate distribution of Comparative Examples 1 to 4, the peak of resin flow rate is found at the center (i.e. in the region C). In the regions A and B, the resin flows little. Meanwhile, in Comparative Examples 2 and 4, small peaks are found in the regions A and B but the peak height is lower than a half of the region C. Therefore, the uneven flow index increases and the flow rate becomes uneven at the die outlet, so that the stability during the manufacture is reduced significantly. Also, the foaming degree becomes uneven, the position of the core wires is biased, and the symmetry degree $\alpha$ becomes more than 0.10.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A differential signal transmission cable, comprising:

two core wires; and a foamed insulation that collectively covers the two core wires by foaming extrusion molding, wherein the foamed insulation is not more than 5% in a dispersion of foaming degree defined by a difference between a foaming degree (%) in the region with a maximum foaming degree and a foaming degree (%) in the region with a minimum foaming degree, in a cut surface when the cable is cut orthogonally to a longitudinal direction of the cable, wherein the cut surface is defined by five regions which are determined according to the next procedures (a) to (c);

(a) A line $X_a$ contacting with upper ends of the two core wires and a line $X_b$ contacting with lower ends of the two core wires are drawn so as to reach both horizontal ends of the foamed insulation or (b) A line $Y_a$ and a line $Y_b$ contacting with opposite ends of the two core wires and orthogonal to the line $X_a$ and $X_b$ are drawn so as to reach both vertical ends of the foamed insulation or (c) The five regions are each defined as a region A surrounded by a line $X_a$, a line $X_b$, a line $Y_a$ and an outer periphery of the foamed insulation between the line $X_a$ and the line $X_b$, a region B surrounded by the line $X_a$, the line $X_b$, a line $Y_b$ and an outer periphery of the foamed insulation between the line $X_a$ and the line $X_b$, a region C surrounded by the line $X_a$, the line $X_b$, the line $Y_a$ and the line $Y_b$, a region D surrounded by the line $X_a$, the line $Y_a$, the line $Y_b$ and an outer periphery of the foamed insulation between the line $Y_a$ and the line $Y_b$, and a region E surrounded by the line $X_b$, the line $Y_a$, the line $Y_b$ and an outer periphery of the foamed insulation between the line $Y_a$ and the line $Y_b$.

2. The differential signal transmission cable according to claim 1, wherein the cable is not more than 0.10 in a symmetry degree $\alpha$, which is defined as a value obtained by dividing the distance (L) by a diameter (a) of the core wire, where in the cut surface, a line X is drawn so as to pass through centers of the two core wires, wherein a midpoint of a line to connect the centers of the two core wires on the line X is defined as an origin Lo(0,0) and intersections between the line X and an outer periphery of the foamed insulation are defined as $X_1$ and $X_2$, wherein the midpoint of the line $X_1$-$X_2$ to connect $X_1$ and $X_2$ is defined as Lx, wherein a line Y that passes through the $L_x$ and is orthogonal to the line $X_1$-$X_2$, intersections between the line Y and an outer periphery of the foamed insulation are defined as $Y_1$ and $Y_2$, wherein a midpoint of the line $Y_1$-$Y_2$ to connect $Y_1$ and $Y_2$ is defined as Ly, and a linear distance between the origin $L_o$(0,0) and $L_y$ is defined as L.

3. The differential signal transmission cable according to claim 1, wherein a skew of not more than 5 ps/m is obtained.

4. The differential signal transmission cable according to claim 2, wherein a skew of not more than 5 ps/m is obtained.

5. A method of making a differential signal transmission cable that comprises: two core wires; and a foamed insulation that collectively covers the two core wires by foaming extrusion molding, wherein the foamed insulation is not more than 5% in a dispersion of foaming degree defined by a difference between a foaming degree (%) in the region with a maximum foaming degree and a foaming degree (%) in the region with a minimum foaming degree, in a cut surface when the cable is cut orthogonally to a longitudinal direction of the cable, wherein the cut surface is defined by five regions which are determined according to the next procedures (a) to (c);

(a) A line $X_a$ contacting with upper ends of the two core wires and a line $X_b$ contacting with lower ends of the two core wires are drawn so as to reach both horizontal ends of the foamed insulation or (b) A line $Y_a$ and a line $Y_b$ contacting with opposite ends of the two core wires and orthogonal to the line $X_a$ and $X_b$ are drawn so as to reach both vertical ends of the foamed insulation or (c) The five regions are each defined as a region A surrounded by a line $X_a$, a line $X_b$, a line $Y_a$ and an outer periphery of the foamed insulation between the line $X_a$ and the line $X_b$, a region B surrounded by the line $X_a$, the line $X_b$, a line $Y_b$ and an outer periphery of the foamed insulation between the line $X_a$ and the line $X_b$, a region C surrounded by the line $X_a$, the line $X_b$, the line $Y_a$ and the line $Y_b$, a region D surrounded by the line $X_a$, the line $Y_a$, the line $Y_b$ and an outer periphery of the foamed insulation between the line $Y_a$ and the line $Y_b$, and a region E surrounded by the line $X_b$, the line $Y_a$, the line $Y_b$ and an outer periphery of the foamed insulation between the line $Y_a$ and the line $Y_b$, the method comprising controlling an uneven flow index of an extruded resin so that it is not more than 1.5, where the uneven flow index is defined as a value obtained by dividing resin maximum flow rate in a die by a resin mean flow rate in the die at the time of foaming extrusion molding that the two core wires are collectively covered with the foamed insulation.

* * * * *